US005894975A

United States Patent [19]

Holden et al.

[11] Patent Number: 5,894,975

[45] Date of Patent: Apr. 20, 1999

[54] CARRIERS AND INTERCHANGEABLE LINER THEREFOR

[76] Inventors: Nancy Holden, 969 Hillsboro Mile, Hillsboro Beach, Fla. 33062-2301; Pamela Hartman, 1779 Mt. Olivet Church Rd., Lexington, N.C. 27295; Jeanne Alfaro, 2140 Sherwood Forest Blvd., Apt. 9, West Palm Beach, Fla. 33406

[21] Appl. No.: 08/880,780

[22] Filed: Jun. 23, 1997

[51] Int. Cl.[6] ..... A45C 1/02; A45C 13/02; B65D 30/08

[52] U.S. Cl. ..... 224/582; 224/581; 224/645; 224/610; 150/101; 150/104; 383/2; 383/111

[58] Field of Search ..... 224/575, 581, 224/582, 645, 610; 150/104, 105, 101, 129, 103, 113; 190/110, 125, 103; 383/111, 2

[56] References Cited

U.S. PATENT DOCUMENTS

| | | | |
|---|---|---|---|
| 2,029,905 | 2/1936 | Banner | 150/28 |
| 2,493,506 | 1/1950 | Schwartzbard | 150/28 |
| 2,609,854 | 9/1952 | Rosen | 150/104 |
| 2,672,903 | 3/1954 | Machinist | 150/28 |
| 2,771,112 | 11/1956 | Ingram | 150/35 |
| 2,799,316 | 7/1957 | Cohen | 150/101 |
| 2,802,501 | 8/1957 | Stember | 150/36 |
| 2,893,457 | 7/1959 | Wilson | 150/113 |
| 3,414,033 | 12/1968 | Tucker | 150/104 |
| 3,726,329 | 4/1973 | Dean | 150/28 |
| 4,177,909 | 12/1979 | Haskell | 224/153 |
| 4,257,463 | 3/1981 | Monaco | 150/35 |
| 4,263,951 | 4/1981 | Siegel | 150/113 |
| 4,756,394 | 7/1988 | Cohen | 190/18 |
| 5,207,254 | 5/1993 | Fromm | 150/104 |
| 5,509,515 | 4/1996 | Guo | 190/110 |

*Primary Examiner*—Linda J. Sholl
*Attorney, Agent, or Firm*—Kennedy, Davis & Kennedy

[57] ABSTRACT

A system of selectable carriers for receiving an interchangeable liner enclosing a plurality of articles for facilitating exchange of articles from one selected carrier to another. The system provides a plurality of carriers which each have at least an opening with a first connecting member having a first character and attached near the opening thereof. The carriers selectively engage a liner that has a closed bottom and an open end with a second connecting member having a second character attached to a perimeter edge thereof, for selective mating engagement of the liner with the first connecting member in the carrier, for joining the liner to the carrier. The liner receives a plurality of articles to be carried within the carrier, and transfer of which occurs substantially simultaneously by transferring the liner and the articles therein from one carrier to another selected one of the carriers.

9 Claims, 2 Drawing Sheets

CARRIERS AND INTERCHANGEABLE LINER THEREFOR

TECHNICAL FIELD

The present invention relates to carriers of articles. More particularly, the present invention relates to a system of carriers such as purses and handbags that receive an interchangeable liner therein for holding and transferring articles between carriers.

BACKGROUND OF THE INVENTION

Carrying devices such as luggage, purses, backpacks, and the like, have been used for a number of years for containing and carrying articles for use by persons. For example, persons attending school often carry books, papers, and supplies in backpacks or book satchels. Personal articles likewise are frequently carried in purses or handbags. These personal articles include a wide range of items, writing instruments, and more.

In addition to the utilitarian functions, carriers also have an ornamental and fashion function. Purses, handbags, pocket books, and backpacks, and the like are available in a wide range of shapes, colors, and sizes. Often one type of carrier is suitable for one occasion and not for others. For example, purses are available in a variety of styles and sizes which are deemed appropriate for one occasion but not for another. A small hand-held clasp bag, narrow in width, is typically appropriate for evening dress occasions, whereas a pocketbook having a short strap handle is considered more appropriate for ordinary daily use. A larger handbag with a longer strap may be particularly useful for shopping occasions. It is not unusual for fashion wardrobes to include a number of different purses of various sizes, shapes, and styles for use depending on the particular occasion.

While a particular carrier used on an occasion may differ from an earlier occasion, the articles contained within these carriers is typically the same. The carrier will contain a wallet for money and credit cards, identification, keys, and other personal articles particular to the individual. The carriers accordingly enclose a wide range of articles. When changing from one carrier to another, the transfer of articles from the previous carrier to the next carrier is a somewhat time consuming activity involving searches of the former carrier, identification of articles to transfer to a subsequent carrier, and transferring of the articles. Often most, if not all, of the articles are transferred from the former carrier to the subsequent carrier.

Accordingly, there is a need in the art for an improved system of carriers for facilitating the transfer of articles between carriers. It is to the provision of such that the present invention is directed.

SUMMARY OF THE INVENTION

The present invention meets the need in the art by providing a system of carriers and an interchangeable liner apparatus for facilitating exchange of articles from one carrier to another selected carrier. Each carrier has at least an opening with a first mating member attached to a perimeter edge of the opening. A liner has a closed bottom and an open end with a second mating member attached to a perimeter edge of the open end. The liner is for receiving a plurality of articles to be held within the carrier. The liner is inserted into a selected one of the carriers and attached thereto by engaging the first and the second mating members. The carrier includes a closure means for closing the open end of the carrier. Transfer of the articles occurs substantially simultaneously by transferring the liner with the articles therein to the selected one of the carriers.

Objects, features, and advantages of the present invention will become apparent from a reading of the following specification, in conjunction with the drawings and the appended claims.

DETAILED DESCRIPTION OF THE PREFERRED EMBODIMENTS

Figure 1:
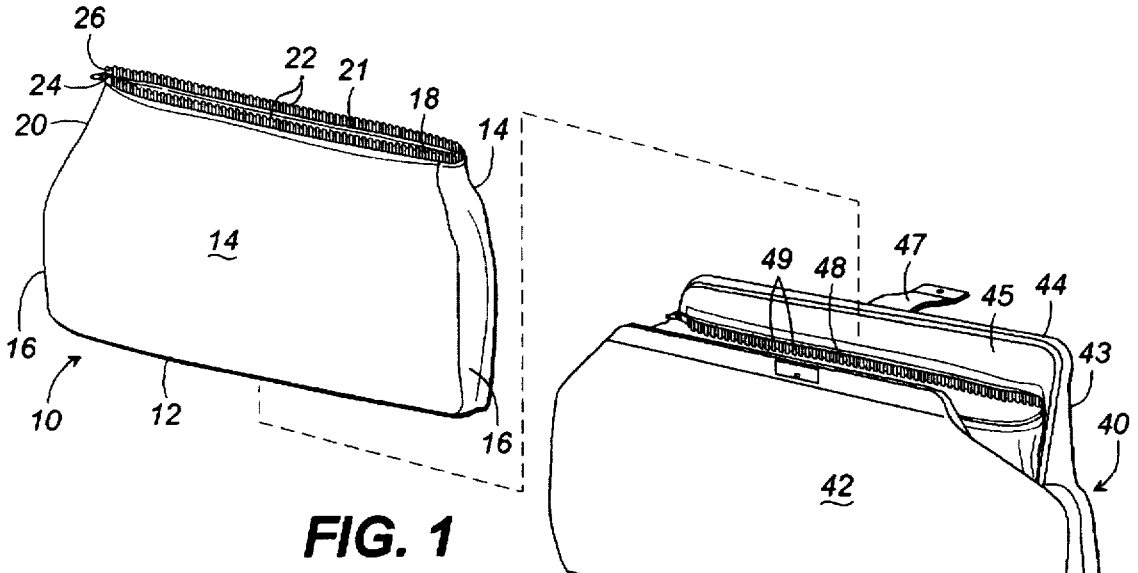
FIG. 1 is a perspective view of an embodiment of the liner of the present invention exploded from a carrier which receives the liner.

Referring now in more detail to the drawings in which like numerals indicate like parts throughout the several views, FIG. 1 illustrates in perspective view a liner 10 according to the present invention exploded from a carrier 40. The liner 10 is formed of a sheet material, such as a fabric, which is folded to define a bottom 12 and opposing elongate panels 14. The edges of the sheet are sewn together to define lateral sides 16 for the liner 10. The liner 10 has an open end 18. The liner 10 accordingly defines a flexible open-ended receptacle for receiving articles.

The open end 18 has a perimeter edge 20. A connector generally 21 attaches to the liner 10 at the open end 18. The connector 21 comprises a component of a mating connector, which component has a first character for mating engagement with a second component of the mating connector, which second component has a second character, as described below. In the illustrated embodiment, the connector 21 comprises a first component of a zipper. The first component conventionally comprises an elongate row of teeth 22 attached to a fabric flange that is attached by sewing to the perimeter edge 20 of the open end 18. A sliding piece 24 is disposed at an end 26 for travel along the length of the first component zipper, for connecting the first component to the second component, as discussed below. In alternate embodiments, the connectors comprise tab and receptacle snaps, hook and loop mating surfaces, buttons and slots, hooks, groove and spline slide connectors, and the like, which function to detachably engage two surfaces or articles together.

Exploded from the liner 10 in FIG. 1 in perspective view is an evening-style handbag 40 comprising opposing side walls 42 and 43, and a hinged metal U-shaped frame 44 which defines an opening 45 that is opposed to a bottom 46. The handbag 40 further has a clasp 47 for selective securing the hingedly-opened sides of the handbag 40 in a closed position. The handbag 40 is considerably different from a conventional purse or handbag for, as illustrated, the handbag 40 is provided with a connector 48 for mating engagement with the connector 21 in the liner 10. In the illustrated embodiment, the connector 48 is a second component of a zipper having an elongate row of teeth 49 attached to a fabric flange. The connector 48 attaches to an interior portion 49 of the open end 45 of the handbag 40. The connector 48 is preferably recessed from approximately ½ inch from the perimeter top edge of the frame 44 in the handbag 40. The connector 48 provides the second mating component for the first mating component 21 used for connecting the liner 10 to the handbag 40, as discussed below. In a preferred embodiment, the evening-style handbag has a size of approximately thirteen inches long by six inches deep. As may be appreciated, the handbag 40, and the others disclosed herein may be made of fabrics, vinyl, leather, or other conventional sheet materials for forming handbags and carriers. In an alternate embodiment (not illustrated), the handbag 40 has a conventional outside flap that overfolds from one perimeter edge adjacent the opening 45 to cover the opening. The flap is secured to the front panel 42 with a clasp, magnet, or other fastener.

Figure 2:
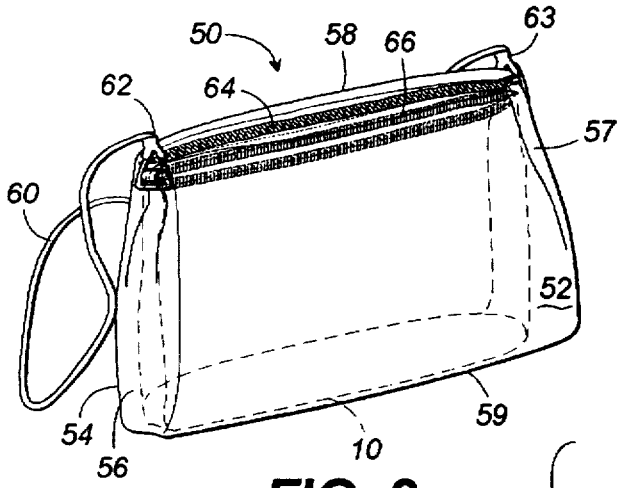
FIG. 2 is a perspective view of an alternate embodiment of a carrier which receives the liner illustrated in FIG. 1.

FIG. 2 is a perspective view of a handbag 50 and the liner 10 shown in phantom as received within the handbag. The handbag 50 comprises a pair of opposing side walls 52 and 54 and a pair of opposing end walls 56 and 57. The handbag 50 has an openable end 58 opposite a bottom panel 59. An elongate strap 60 attaches at distal ends 62, 63 to upper ends of the side walls 56 and 58. The handbag 50 has a closer 64 to selectively secure the open end 58 of the handbag in a closed position. In the illustrated embodiment, the closer 64 is an elongate zipper which is recessed from the perimeter edge of the side walls 52, 54. Further, the handbag 50 also includes a second mating connector 66 for engaging the connector 21 on the liner 10. The second connector 66 is preferably recessed interior of the handbag from the perimeter edge of the openable upper end thereof. In a preferred embodiment, the handbag 50 with carrying handle is approximately thirteen inches long by ten inches deep.

Figure 3:
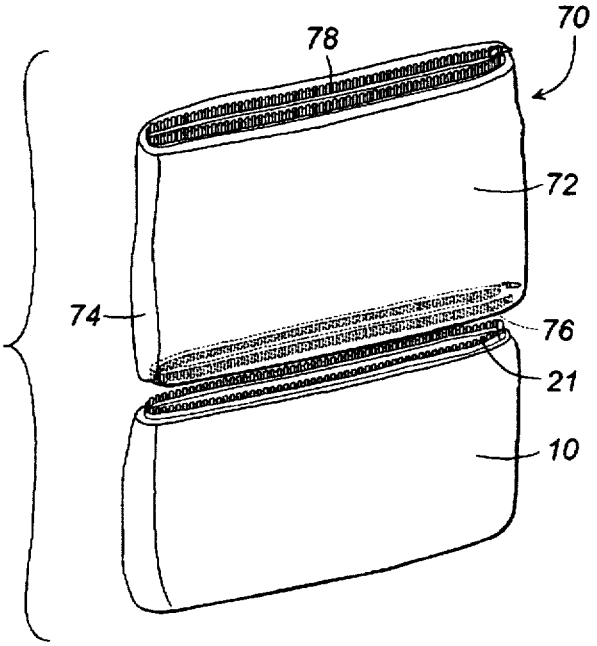
FIG. 3 is a perspective view of the liner illustrated in FIG. 1 with an extender.

FIG. 3 is a perspective view of a tube-like extender 70 which is useful in an alternate embodiment of the liner 10 of the invention. The sleeve-like extender 70 is detachably received on the open end 18 of the liner 10. The extender 70 comprises an open-ended fabric tube having opposing side walls 72 and opposing end walls 74. A first connector 76 attaches to a lower end of the extender 70. The first connector 76 has a character for mating engagement with the connector 21 on the liner 10. A second connector 78 attaches to an upper end of the extender 70. The second connector 78 has a character of the type as the connector on the liner 10 for mating engagement with connectors of the second character in the illustrated handbags 40 and 50.

Figure 4:
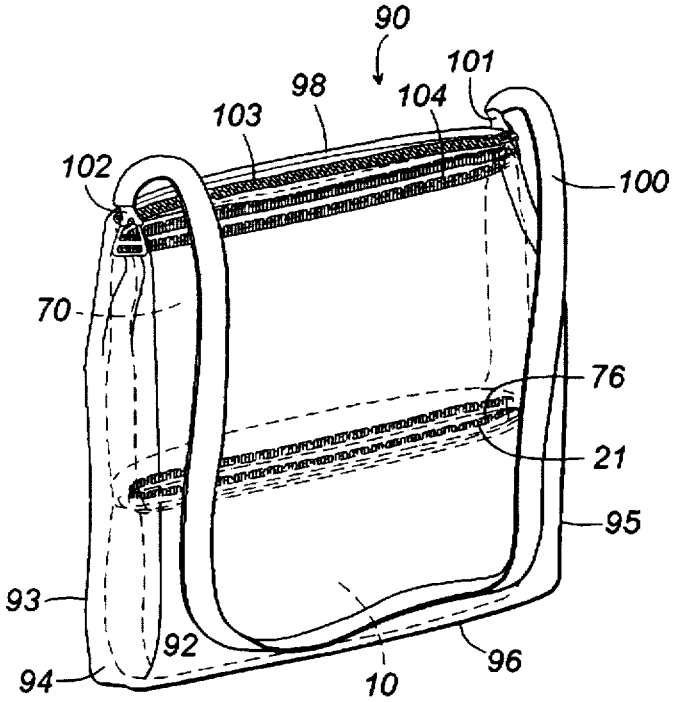
FIG. 4 is a perspective view of the liner and extender illustrated in FIG. 3 received in an alternate embodiment of the carrier therefor.

FIG. 4 is a perspective view of a knapsack-style bag or carrier 90 having opposed side walls 92, 93 and opposed end walls 94, 95. The bag 90 is closed at a bottom 96 and has a selectively closable opposing upper end 98. A strap 100 attaches at respective distal ends 101, 102 to the upper edges of the side walls 92, 93 for receiving the strap over a shoulder of a person using the bag. The open end 98 is selectively closed by a closer 103. In the illustrated embodiment, the closer 103 is a zipper. However, the closer 103 may comprise a clasp and latch, mating components of snaps, a button and loop, drawstring or other convention closing device. Recessed from the closer 103 is a connector 10. The connector 104 on the interior of the carrier 90. The connector 104 has a character for mating engagement with the second connector 78 of the extender 70 or selectively with the connector of the liner 10. In a preferred embodiment, the carrier 90 is thirteen inches long by sixteen inches deep.

The liner 10 is gainfully used to contain articles to be carried in a carrier such as a purse, handbag, short-handle bag, a strap bag, a knapsack bag, and day bag, a night bag, an evening bag, and like such carriers, as illustrated, according to the present invention. As illustrated in FIG. 1 with a representative one of such carriers, each of these carriers has at least one opening (18) with the connector (21) attached near the perimeter edge of the opening for selective engagement of the liner 10 with the carrier. With reference to FIG. 1, the clasp 46 is released and the handbag 40 is opened by pivoting the U-frame 44 outwardly. The liner 10 is received within the handbag 40. The connector 21 of the liner 10 is matingly engaged with the connector 48 of the handbag 40. The liner 10 is thereby received in and attached to the handbag 40. The handbag 40 then is used as a handbag for carrying articles such as wallet, keys, identification. The line 10 defines a receiver for enclosing such articles within the closable carrier.

Upon change of occasions or other need for a second different handbag, the liner 10 is readily exchanged with the articles therein to a second selected handbag. With reference to FIGS. 1 and 2, the handbag 50 is opened by opening the closer 64. The clasp 46 of the handbag 40 is released and the handbag opened by pivoting the U-frame 44 apart. The liner 10 is releasably detached from its engagement with the handbag 40 by separating the connector 21 of the liner 10 from the connector 48 of the handbag. The liner 10 is removed from the handbag 40 and is inserted into the handbag 50 with the contents remaining therein. The connector 66 of the handbag 50 is engaged to the connector 21 on the liner 10. The liner 10 is thereby received within the newly selected handbag 50 and attached thereto. In this way, the contents of the handbag 40 are moved to the handbag 50 as a group substantially simultaneously.

With reference to FIGS. 3 and 4, the liner 10 is adaptable for use in larger carriers. The liner 10 readily connects to the extender 70 by joining the connector 21 on the liner 10 with the first connector 76 of the extender. This forms an enlarged liner for insertion into the larger knapsack-styled bag 90. This is accomplished by first opening the closer 102 of the bag 90. The expanded liner 70 is inserted into the bag 90. The connector 104 is matingly engaged to the second connector 78 on the extender 70. The contents of the liner 10 are thereby held within the knapsack-style handbag 90. The closer 102 is operated to close the bag 90 which is then carried with the strap 100 looped over the shoulder of the user.

The exchange of the liner 10 is similarly accomplished as discussed above for ready and convenient transfer of articles as a group from one handbag to another handbag as selectively required by the user. In an alternate embodiment (not illustrated), the liner 10 without the extender 70 is readily attached by the connector 21 to the connector 104 of the knapsack-style handbag 90. This defines a "secret" compartment within the knapsack-style bag 90. This compartment is accessible only by opening the closer 102 and separating a portion of the engaged connectors 104 and 21, whereby access is joined between the inner walls of the bag 90 and the liner 10.

Although not illustrated, each of the handbags 40, 50, and 90, may include pockets or recesses for receiving articles separately from the liner 10. Further, the handbags may include stylish closers which include a flat member that folds over the opening of the bag and is secured with a latch, clasp, snap, or magnet to a front panel.

Figure 5:
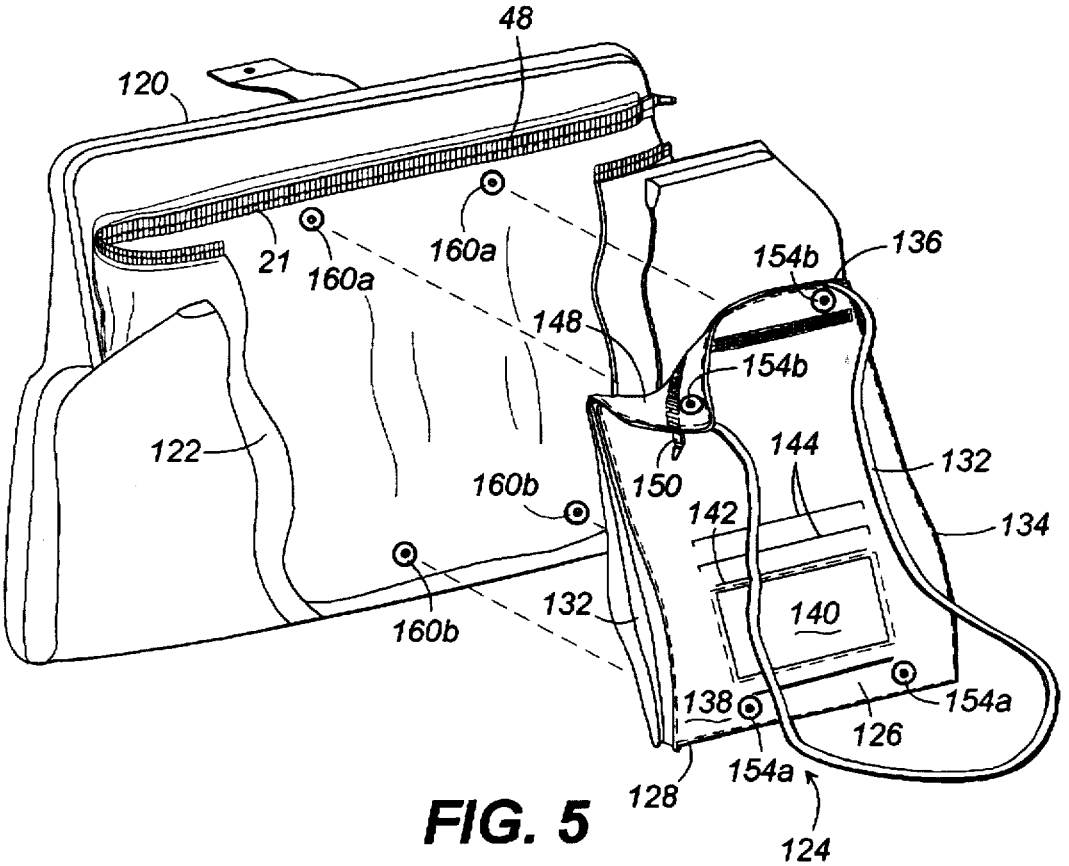
FIG. 5 is a perspective cut-away view of an alternate embodiment of the liner illustrated FIG. 1 with a detachable clutch case, received in a carrier.

FIG. 5 is a perspective cut-away exploded view of an alternate embodiment 122 of the liner 10 which is held within a carrier 120. The liner 122 is the same as the liner 10 discussed above, but includes additional features discussed below, in order for the liner 122 to receive and engage a clutch case 124. The clutch case 124 in the illustrated embodiment comprises a pair of sheet members 126 which are engaged together by sewing around a perimeter edge 128. A strap 132 is engaged to opposing sides 134 of the clutch case 124. The strap 132 extends freely from an upper end 136 of the clutch case 134. A first side 138 of the clutch case 124 includes a window 140. A slit 142 in the sheet 126 adjacent the window 140 permits sliding insertion and removal of a card, such as a photo I.D. for display in the window 140. The first side 138 also includes a plurality of slits 144, which open to pockets for receiving articles such as credit cards and the like.

An opposite side 148 of the clutch case 124 includes an opening remote from the window 140. In the illustrated embodiment, the opening is closed by a zipper 150. An interlining between the sheets 126 defines a pocket portion which is accessible through the opening 148. The clutch case 124 further includes fasteners for engaging the clutch case to the interior of the liner 122. In the illustrated embodiment, two pairs of fasteners 154 are attached to the first face of the clutch case. A pair of female snaps **154*a* are secured in spaced-apart relation to a lower portion of the first side 138 of the clutch case. A pair of male snaps 154*b* are secured to an upper portion of the clutch case in alignment with the pair of female snaps 154*a*. When the clutch case 124 is folded along a medial transverse axis, the male snaps 154*b* engage the female snaps 154*a* to secure the clutch case together. Further, the clutch case 124 is selectively secured to an inner portion of the liner 122 which includes mating fasteners for engaging the fasteners of the clutch case 124. A pair of female snaps 160*a* are disposed spaced-apart to an upper portion of the liner 122. A pair of spaced-apart male snaps 160*b* are secured to the lower portion of the liner 122. The clutch case is selectively engaged to the interior of the liner 122 by securing the respective snaps 154*a*, 160*b* and 154*b*, 160*a* together, after the clutch case is inserted into the liner 122. When the clutch case 124 is disposed within the liner 122, the strap 132 is received within the pocket and closed by the zipper. The liner 122 is selectively transferred together with the articles therein to another carrier as discussed above. It is noted that although four pairs of mating fasteners are used in the illustrated embodiment for securing the clutch case 124 to the liner 122**, one pair of fasteners can be used.

The specification as thus described in various embodiments, the carriers of the present invention having interchangeable liner apparatus, and including the manufacture and use thereof. It is to be understood, however, that numerous changes and variations may be made in the construction of the present invention. It should therefore be understood that modifications to the present invention may be made without departing from the scope thereof as set forth in the appended claims.

What is claimed is:

1. A carrier and interchangeable liner for facilitating exchange of articles from one selected carrier to another, comprising:

a plurality of carriers selected from a group comprising a handbag, a short-handled bag, a strap-bag, a knapsack bag, a day-style bag, a night-styled bag, an evening-style bag, each carrier having at least an opening with a first connecting member attached near the opening thereof, the first connecting member having a first character;

a liner having a closed bottom and an open end with a second connecting member attached to a perimeter edge thereof, the second connecting member having a second character for selective mating engagement with the first connecting member for joining the liner to the carrier, the liner for receiving a plurality of articles to be carried within the carrier, whereby the liner is inserted into a selected one of the carriers and attached thereto by engaging the first and the second mating members;

at least one fastener of a first character attached to an interior surface of the liner;

a clutch purse having at least one fastener of a second character for mating engagement with the fasteners in the liner, whereby the clutch purse is detachably engagable to the interior of the liner;

a tubular extender having a first connector at a first open end and a second connector at a second open end, the first connector of the extender having a character for mating engagement with the second connector of the liner and the second connector of the extender having a first character for mating engagement with the first connecting member of the carrier, whereby the extender increases the size of the liner being received into one of the selected carriers; and closure means for closing the open end of the carrier, whereby transfer of the articles within the liner occurs substantially simultaneously by transferring the liner and the articles therein to another selected one of the carrier.

2. The carrier and interchangeable liner as recited in claim 1, wherein the first and second mating members are zippers.

3. A system of selectable carriers for receiving an interchangeable liner enclosing a plurality of articles for facilitating exchange of articles from one selected carrier to another, comprising:

a plurality of carriers, each having at least an opening with a first connecting member attached near the opening thereof, the first connecting member having a first character;

a liner having a closed bottom and an open end with a second connecting member attached to a perimeter edge thereof, the second connecting member having a second character for selective mating engagement with the first connecting member for joining the liner to the carrier, the liner for receiving a plurality of articles to be carried within the carrier, whereby the liner is inserted into a selected one of the carriers and attached thereto by engaging the first and the second mating members; and a tubular extender having a first connector at a first open end and a second connector at a second open end, the first connector of the extender having a character for mating engagement with the second connector of the liner and the second connector of the extender having a first character for mating engagement with the first connecting member of the carrier, whereby the extender increases the size of the liner being received into one of the selected carriers, whereby transfer of the articles within the liner occurs substantially simultaneously by transferring the liner and the articles therein to another selected one of the carriers.

4. The system as recited in claim 3, wherein the carriers each further comprise a closer for securing the opening therein in a closed position.

5. The system as recited in claim 3, wherein the first and second connecting members comprise a zipper having teeth that matingly engage for securing the liner to the carrier.

6. The system as recited in claim 3, wherein the carriers comprise handbags.

7. The system as recited in claim 6, wherein at least one of the handbags further comprises an elongated loop attached to the handbag for carrying said handbag thereby.

8. The system as recited in claim 3, wherein the liner further comprises at least one fastener of a first character attached to an interior surface of the liner; and further comprising:

a clutch purse having at least one fastener of a second character for mating engagement with the fasteners in the liner, whereby the clutch purse is detachably engagable to the interior of the liner.

9. The system as recited in claim 3, wherein the carriers are selected from a group comprising a handbag, a short-handled bag, a strap-bag, a knapsack bag, a day-style bag, a night-styled bag, and an evening-style bag.

* * * * *